United States Patent [19]

Domenighetti

[11] Patent Number: 4,682,908

[45] Date of Patent: Jul. 28, 1987

[54] DEVICE FOR CONTROLLING THE PRESSURE UPON THE GROUND OF A SCREED UNIT OF VIBRATING FINISHING MACHINE FOR ROAD PAVING

[75] Inventor: Domenico Domenighetti, Lugano, Switzerland

[73] Assignee: Simesa-Societa Italiana Montaggi e Servizi Affini S.p.A., Milan, Italy

[21] Appl. No.: 763,263

[22] Filed: Aug. 6, 1985

[30] Foreign Application Priority Data

Sep. 4, 1984 [IT] Italy ..... 22511 A/84

[51] Int. Cl.[4] ..... E01C 19/22

[52] U.S. Cl. ..... 404/84; 404/118

[58] Field of Search ..... 404/84, 118, 119

[56] References Cited

U.S. PATENT DOCUMENTS

| | | | |
|---|---|---|---|
| 3,158,945 | 12/1964 | Curlett et al. | 404/84 |
| 3,285,148 | 11/1966 | Munyon | 404/84 |
| 3,907,451 | 9/1975 | Fisher et al. | 404/118 |
| 3,989,402 | 11/1976 | James, III | 404/84 |
| 3,992,124 | 11/1976 | Schrader | 404/118 |
| 4,026,658 | 5/1977 | Newendorf et al. | 404/84 |
| 4,379,653 | 4/1983 | Brown | 404/118 |

FOREIGN PATENT DOCUMENTS

| | | | |
|---|---|---|---|
| 2333371 | 1/1975 | Fed. Rep. of Germany | 404/84 |

*Primary Examiner*—Stephen J. Novosad
*Assistant Examiner*—Hoang C. Dang
*Attorney, Agent, or Firm*—Young & Thompson

[57] ABSTRACT

A device for controlling the pressure of the extensible screed of a road paver on the material to be laid down, comprising hydraulic actuators capable of lifting the screed unit and structure for regulating the pressure of the hydraulic fluid without varying the vertical position of said screed, including distributors, non-return valves, maximum pressure valves and, at least one accumulating chamber, wherein an electric circuit for transmitting signals acts upon the hydraulic circuit to adjust the pressure of the fluid in the actuators.

2 Claims, 4 Drawing Figures

FIG.1
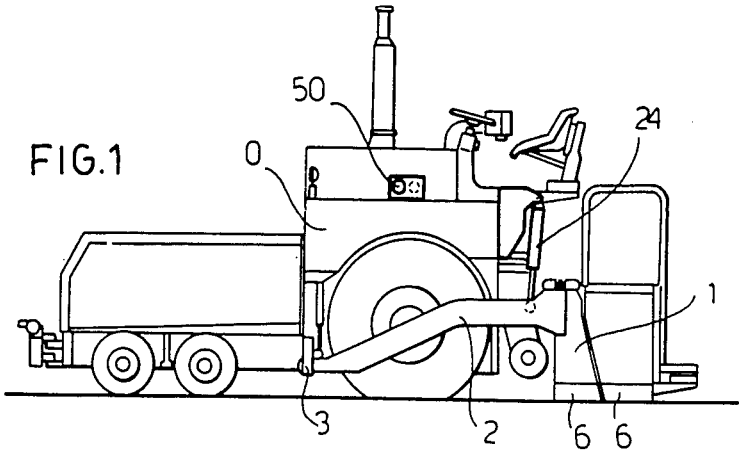
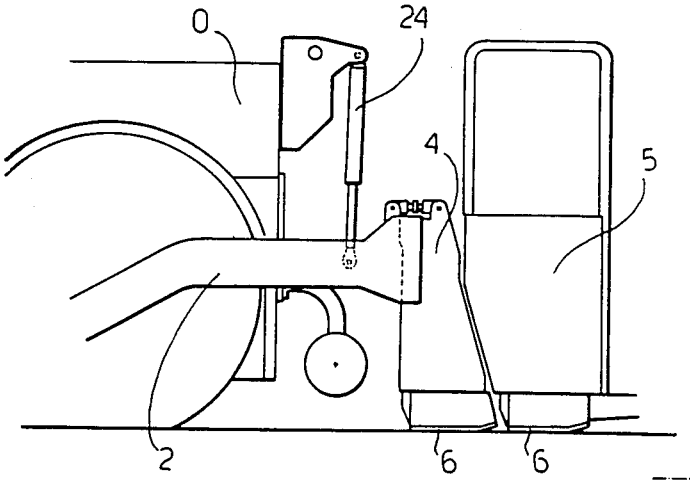
FIG.2
FIG.3
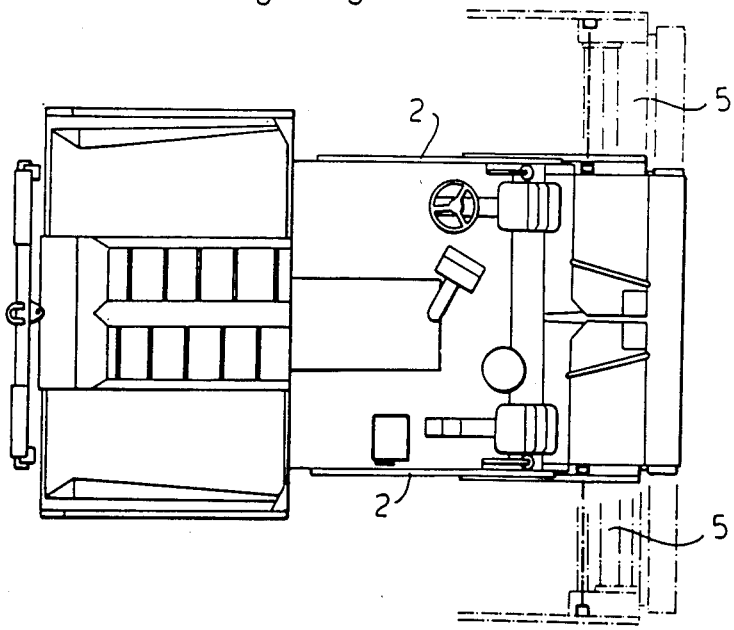

DEVICE FOR CONTROLLING THE PRESSURE UPON THE GROUND OF A SCREED UNIT OF VIBRATING FINISHING MACHINE FOR ROAD PAVING

The present invention relates to a device for automatically controlling the pressure exerted by the extensible screed of a vibratory finishing machine for road paving on the material to be laid down.

In particular, the present invention is a considerable improvement of the device described in Italian Pat. No. 741,035 of Sept. 17, 1964. This device automatically controls the pressure of the vibrating screed whereas the pressure was previously manually controlled. Furthermore it provides for the controls of the members provided therefore.

An exemplary embodiment of the invention is illustrated in the accompanying drawings, in which a finishing machine on tired wheels is shown. Of course, the device can also be applied to other types of finishing machines, for example, self-driven machines on tracks.

In the accompanying drawings:

FIG. 1 is a side elevational view of the finishing machine with automatic controls.

FIG. 2 is an enlargement of the back of the machine shown in FIG. 1.

FIG. 3 is a plan view of the machine of FIG. 1

Figure 4:
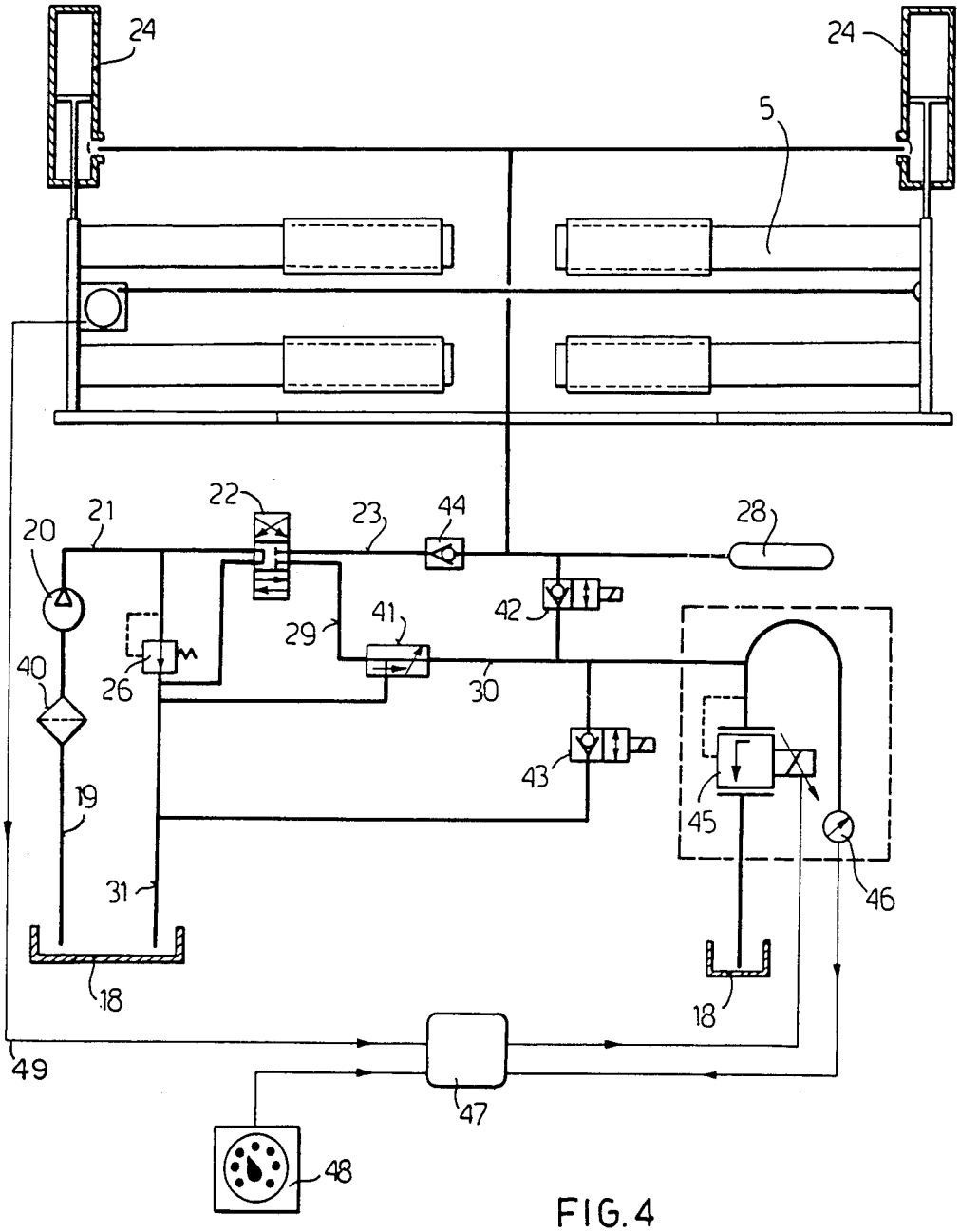
FIG. 4 shows the hydraulic diagram for the oleostatic control of the compensator device, which is the subject of this improved invention.

The finishing machine for bituminous mixes, on which the device of the present invention is fitted, consists basically in a known tractor unit 0 integrated with the proposed improvements. The finisher comprises an extensible screed 1 made up of two longitudinal arms 2, pivoted at their front end about halfway along the tractor unit, for example at 3, and having at the back end of the screed which is of the so-called hydraulically extensible type, a central beam made up of two symmetric elements 4 pivoted to one another (in order to achieve the "crown" angle).

At the rear end of each of these central symmetric elements 4 a hydraulically extensible member 5 is fitted (FIGS. 2 and 3). These elements 4 extend transversely with respect to the machine's forward movement. These members allow the continuous variation of the spread width.

It has been found that the pressure of the bottom surface 6 of the screed 1 upon the asphalt mix to be spread is of fundamental importance for the correct functioning of the machine. In particular a uniform pressure reduces undulation and guarantees an optimum levelling of the layer to be spread on the road, without any further adjustment.

In screeds of the modern hydraulically extensible type, the pressure of the bottom surface of the screed upon the spread material reaches a maximum value, when the two extensible members are fully retracted so that their whole weight bears on the central elements 4.

When said members 5 are fully extended, their weight is directly transferred by the bottom surface 6 onto the spread material, which forms the asphalt carpet. In this case, supposing that the weight of members 5 is about the same as the weight of the central elements 4 and that the same applies to the respective bottom surfaces 6, it can be said that the pressure on the just laid material varies in the ratio of 1:2, when the machine changes from the fully retracted to the fully extended position.

The introduction of modern vibratory finishing machines equipped with hydraulically extensible screeds has made this problem even more serious, since in the case of members which are extensible "by tilting", the variation in pressure is kept within the ratio of 1:1.5, therefore giving rise to less considerable problems than those met by using modern hydraulically extensible screeds.

In order to keep the pressure constant on the just laid material, the device according to the present invention makes use of two oleostatic actuators 24 (FIG. 2), connected at one end to the driving unit 0 and at the other to the arm 2 of the screed unit.

Oil under pressure inserted in the actuator 24 increases the pressure to suitable values, even full lifting of the screed can be achieved.

To obtain the required result of controlling the pressure upon the material to be spread, the pressure of the oil fed to the actuator 24 must be automatically controlled.

An electric-hydraulic circuit, (see FIG. 4) may be used for this purpose, one part of the figure being elementary, while the rest illustrates an embodiment of the present invention.

For semiautomatically controlling the pressure of the screed resting on the bituminous mix to be laid, it is sufficient to control the pressure of the oil feeding the actuators.

The elementary part of the hydraulic circuit illustrated in FIG. 4 is used for this purpose. In this drawing 18 is a hydraulic fluid (oil) tank, 19 a suction pipe for said fluid, 20 a filter, 40 a pump, 21 a high-pressure delivery pipe and 22 a distributor faucet, which can feed the oil either into the delivery pipes 23 and 29 or into the return pipe 31, which sends the hydraulic fluid back to the tank 18.

The delivery pipe 23 is connected to the actuators 24. A maximum presssure regulator 26, to be adjusted from time to time for correct setting, is inserted into the delivery pipe 21.

The valve 26 is fitted with a return tube which allows a part of the fluid to be discharged into the tank 18, so that it can carry out its regulating function.

An accumulator chamber 28 is fitted on the delivery pipe 23.

In the hydraulic circuit extending "downstream" of the distributor 22 there is a so-called "priority" valve 41, the function of which is to channel a predetermined amount of oil to the delivery pipe 30 and discharge the excess thereof by means of the return pipe 31.

In addition, two service distributors 42 and 43, which are operated together with the distributor 22, are provided.

Provision is also made for fitting a nonreturn valve 44 on the delivery pipe 23.

The oil under pressure passing through the delivery pipe 30, reaches a pressure-regulating valve 45, operated electrically, and an electric pressure gauge 46.

These two latter electric-hydraulic devices are connected to an electric circuit, which reaches an amplifying comparator 47, a trimmer 48 and lastly an elongation-measuring sensor 49.

According to a particular embodiment of the present invention, the sensor 49 is composed of a wire, connected at one end of the extensible member 5, while at the other end a winder is foreseen which continually measures the total length L of the extensible member 5 and transmits it by means of said electric circuit to a comparator 47.

The operator, using the trimmer 48, fixes the maximum value M of the oil pressure which is considered suitable for lifting the weight of the extensible members, when these members are fully retracted.

Said trimmer 48 sends the preselected maximum value signal through said electric circuit to the comparator 47, which compares the two values (L) and (M) with the real oil pressure in the circuit as measured by the electric pressure gauge 46 and translates them into a command to valve 45 which makes the necessary adjustments.

Consequently, any variation of the spread width is followed by a timely reaction of the above-described electric-hydraulic equipment, which changes the oil pressure in the two actuators so as to keep constant the pressure of the bottom surface of the screed, resting on the layer of bituminous mix.

The pressure of the screed on the mix, which is kept precisely constant, according to the present invention, independently of any variation of the spread width, can of course be varied by acting on the trimmer 48, in such a way as to adapt the pressure to variable working conditions (plasticity, thickness, etc of the layer of material to be spread, etc.) on the road surface.

What I claim is:

1. Device for automatically controlling the pressure exerted on road paving material by an extensible screed of a finishing machine, said screed comprising a hydraulically laterally extensible member (5) connected to symmetric elements (4) having bottom surfaces (6) that engage the ground when extended, such that the overall width of the extensible screed is determined by the position of the screed symmetric sections (4), said device comprising: hydraulic actuators (24) controlling the motion of said symmetric members (4) and said extensible members (5) and capable of lifting said screed; an electro-hydraulic circuit for regulating pressure of hydraulic fluid circulated within said actuator for varying the vertical position of said screed and means responsive to the amount of lateral extension of said extensible member (5) to adjust the pressure in said circuit for keeping constant the pressure per unit of area of said bottom surfaces (6) of said screed on said road paving material, said circuit keeping said pressure per unit of area constant independently of the overall width of the extensible screed, said electro-hydraulic circuit further comprising a hydraulic circuit for circulating said hydraulic fluid and an electric circuit for transmitting signals which act upon said hydraulic circuit to adjust the pressure of said fluid in said actuators, said hydraulic circuit comprising a tank (18) for said hydraulic fluid, a suction pipe (19) and a pump (40) for drawing fluid from said tank, a filter (20) for filtering fluid delivered from said pump, a high pressure delivery pipe (21) for conveying fluid from said filter, a maximum pressure regulator (26) for said high pressure delivery pipe (21) which regulates the pressure and which has a return tube to discharge fluid back into said tank (18) via a return pipe (31), said high pressure delivery pipe (21) also being connected to a distributor faucet (22), said faucet delivering fluid into a first delivery pipe (23) or a second delivery pipe (29), said first delivery pipe (23) having a non-return valve (44) and an accumulator chamber (28), said second delivery pipe (29) being connected to a priority valve (41), said priority valve functioning to channel a predetermined amount of fluid into a third delivery pipe (30) and to discharge an excess of fluid into said return pipe (31), said fluid from said third delivery pipe (30) flowing to a pressure regulating valve (45) and an electro-pressure gauge (46) and said fluid from said first delivery pipe (23) flowing to said actuators (24).

2. Device according to claim 1, in which said responsive means comprises a wire which is connected at one end to a said extensible member (5) and at the other end to said electrical circuit so that said wire continually measures the length of extension of said extensible member (5), and a comparator (47) by which said length is transmitted to said electric circuit.

* * * * *